US005765937A

United States Patent [19]

Shiau

[11] Patent Number: 5,765,937

[45] **Date of Patent: *Jun. 16, 1998**

[54] MULTI-FUNCTION LIGHTING DEVICE

[76] Inventor: Shoei-Shuh Shiau, No. 10, Alley 1, Lane 551, Sec. 1, Wan-Shou Rd., Guei-Shan Hsiang, Tao-Yuan Hsien, Taiwan

[ * ] Notice: The term of this patent shall not extend beyond the expiration date of Pat. No. 5,560,705.

[21] Appl. No.: 563,022

[22] Filed: Nov. 27, 1995

[51] Int. Cl.[6] ..... F21L 7/00

[52] U.S. Cl. ..... 362/187; 362/205; 362/267; 362/277

[58] Field of Search ..... 362/186, 187, 362/188, 197, 198, 202, 204, 205, 277, 280, 267

[56] References Cited

U.S. PATENT DOCUMENTS

| | | | |
|---|---|---|---|
| 1,248,688 | 12/1917 | Ludescher | 362/187 |
| 4,388,674 | 6/1983 | Sano | 362/186 |
| 4,609,976 | 9/1986 | Geissler | 362/188 |
| 5,213,408 | 5/1993 | Shiau | 362/187 |
| 5,282,116 | 1/1994 | Shiau | 362/205 |
| 5,412,548 | 5/1995 | Yee | 362/187 |
| 5,560,705 | 10/1996 | Shiau | 362/188 |
| 5,588,739 | 12/1996 | Nakao | 362/277 |

FOREIGN PATENT DOCUMENTS

| | | | |
|---|---|---|---|
| 1045860 | 7/1953 | France | 362/204 |
| 2209387 | 5/1989 | United Kingdom | 362/204 |

*Primary Examiner*—Alan Cariaso
*Attorney, Agent, or Firm*—Darby & Darby

[57] ABSTRACT

A multi-function lighting device includes a barrel, a lamp mounted on one end of the barrel, a tubular coupling member secured around one end of the barrel, a tubular sleeve member made of a light transmittable material and sleeved slidably on the coupling member, and a head cap secured to one end of the sleeve member and provided with a reflector therein. The sleeve member is shiftable with respect to the coupling member between a first position, wherein the lamp extends into the reflector so that light may be directed axially, and a second position, wherein the lamp is located in the sleeve member so that light can pass transversely through the sleeve member. The barrel houses a battery therein, and a switch assembly is mounted in the barrel and is connected electrically to the battery and the lamp. The switch assembly is operable so as to interconnect electrically and selectively the battery and the lamp and so as to cause the lamp to generate one of a constant light output and a blinking light output.

9 Claims, 13 Drawing Sheets

MULTI-FUNCTION LIGHTING DEVICE

BACKGROUND OF THE INVENTION

1. Field of the Invention

The invention relates to a lighting device, more particularly to a multi-function lighting device which can be operated as a flashlight and as a signaling baton, and which is capable of providing a blinking light output.

2. Description of the Related Art

Referring to FIG. 1, a conventional variable focusing flashlight disclosed in U.S. Pat. No. 5,213,408 is shown to comprise a conductive barrel 10 for housing a battery unit 12 therein, a tail cap 13 mounted on one end of the barrel 10 and provided with a compression spring 131 for urging the battery unit 12 towards the other end of the barrel 10, a lamp base for mounting a lamp 14 adjacent to the other end of the barrel 10, and a head assembly 17 mounted rotatably on the other end of the barrel 10 and provided with a planar lens 171 and a parabolic reflector 170 with an open tail end to receive the lamp 14. The lamp base includes a stationary receptacle 11 mounted in the other end of the barrel 10, first and second conductors 113, 114 mounted in the stationary receptacle 11 and connected electrically and respectively to lamp terminals of the lamp 14, and a movable receptacle 111 extending through the stationary receptacle 11 and having a first end abutting against the battery unit 12 and a second end abutting against the open tail end of the reflector 170. The first conductor 113 has one end extending radially along the bottom side of the stationary receptacle 11 within the barrel 10. The second conductor 114 couples electrically the lamp 14 and the barrel 10.

The head assembly 17 is mounted threadedly to the barrel 10 so as to be controllably translatable therealong when rotated with respect to the barrel 10, thereby resulting in a variable focusing effect. Rotation of the head assembly 17 in a direction to result in movement toward the barrel 10 eventually causes the reflector 170 to push the movable receptacle 111 and the battery unit 12 and move the battery unit 12 away from the first conductor 113, thereby breaking electrical connection between the lamp 14 and the battery unit 12.

In the aforementioned conventional flashlight, rotation of the head assembly 17 is performed to activate and vary focusing of the flashlight. Since the light output of the conventional flashlight is directed only through the head assembly 17, the flashlight is not ideal for use as a lantern or as a signaling baton.

Referring to FIGS. 2, 3 and 4, a conventional multi-function lighting device disclosed in U.S. Pat. No. 5,412,548 is shown to comprise a head section 18 and an elongate handle 19. The head section 18 includes a slidable coupling 180 which is sleeved on the elongate handle 19 so as to be longitudinally shiftable over the latter, an axially extending elongate sleeve 181 which is secured to and shiftable with the coupling 180 and which is made of a transparent or translucent material so as to permit transmission of light therethrough, and an end cap 182 which is secured to the elongate sleeve 181 and which has a reflector 191 provided therein. A light source 190 is mounted on one end of the elongate handle 19. By shifting the head section 18 over the elongate handle 19, the light source 190 may be made to project into the reflector 191 in the same manner as an ordinary flashlight, as shown in FIG. 2, or may be located within the elongate sleeve 181 to permit use of the lighting device as a signaling baton, as shown in FIG. 3.

Although the head section 18 is longitudinally shiftable over the elongate handle 19, the head section 18 cannot be maintained at a desired position relative to the elongate handle 19. Thus, the conventional lighting device cannot maintain a desired focusing effect.

Referring to FIG. 5, another conventional flashlight disclosed in U.S. Pat. No. 5,282,116 is shown to comprise a barrel 10' for housing a battery 111' therein, and a switch assembly having a switch casing 12' fitted in the barrel 11' adjacent to one end of the latter, and a switching element 16' disposed within the switch casing 12' and connected electrically to the battery 111' via a conductor 161'. A lamp socket assembly is disposed in the barrel 11' and includes a conductive lamp holder 13' which retains a lamp 14' at a front end thereof and which is mounted on one end of the switch casing 12' at a rear end thereof, a tubular insulator 17' which extends into the rear end of the lamp holder 13', and a conductive compression spring 18' which extends into the insulator 17' and which connects electrically the switching element 16' and the lamp 14'. A conductive coupling unit 19' is disposed inside the barrel 10' around the lamp holder 13' to connect electrically the barrel 10' and the lamp holder 13'. A head assembly 15' is mounted threadedly on a front end of the barrel 10' so as to be controllably translatable therealong to achieve a variable focusing effect. The switching element 16' has a button unit 163' which extends out of a radial opening formed in the barrel 10' and which is operable so as to selectively activate of the flashlight.

Like the conventional flashlight shown in FIG. 1, the conventional flashlight of FIG. 5 is also not ideal for use as a lantern or as a signaling baton.

A signaling baton which can provide a blinking light output is known in the art. However, the known signaling baton cannot function as a flashlight. In addition, a conventional flashlight which can provide a blinking light output is also known in the art. However, the known flashlight requires two switch units, one to control activation of the flashlight and the other to control blinking operation of the same, thereby resulting in a larger and more complicated construction.

SUMMARY OF THE INVENTION

Therefore, the object of the present invention is to provide a multi-function lighting device which can be operated as a flashlight and as a signaling baton and which is capable of providing a blinking light output.

Accordingly, the multi-function lighting device of the present invention includes a barrel, a lamp mounted on one end of the barrel, a tubular coupling member secured around one end of the barrel, a tubular sleeve member made of a light transmittable material and sleeved slidably on the coupling member, and a head cap secured to one end of the sleeve member and provided with a reflector therein. The sleeve member is shiftable with respect to the coupling member between a first position, wherein the lamp extends into the reflector so that light may be directed axially, and a second position, wherein the lamp is located in the sleeve member so that light can pass transversely through the sleeve member. The barrel houses a battery therein, and a switch assembly is mounted in the barrel and is connected electrically to the battery and the lamp. The switch assembly is operable so as to interconnect electrically and selectively the battery and the lamp and so as to cause the lamp to generate one of a constant light output and a blinking light output. The switch assembly comprises: an insulated hollow seat member mounted to the barrel and having angularly spaced first, second and third electrical contacts mounted thereon, the first electrical contact being connected electrically to the battery, the second electrical contact being connected electrically to the lamp; a pulse generating circuit having an input terminal connected electrically to the third electrical contact and an output terminal connected electrically to the lamp; and a conductive connector disposed rotatably in the seat member and formed with a pair of conductive contacts, the connector being manually operable to rotate relative to the seat member among a switch-off position, wherein the conductive contacts of the connector are not in contact with the electrical contacts on the seat member so as to turn off the lamp, a first switch-on position, wherein the conductive contacts of the connector are in contact with the first and second electrical contacts on the seat member so as to control the lamp to generate the constant light output, and a second switch-on position, wherein the conductive contacts of the connector are in contact with the first and third electrical contacts on the seat member so as to control the lamp to generate the blinking light output.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
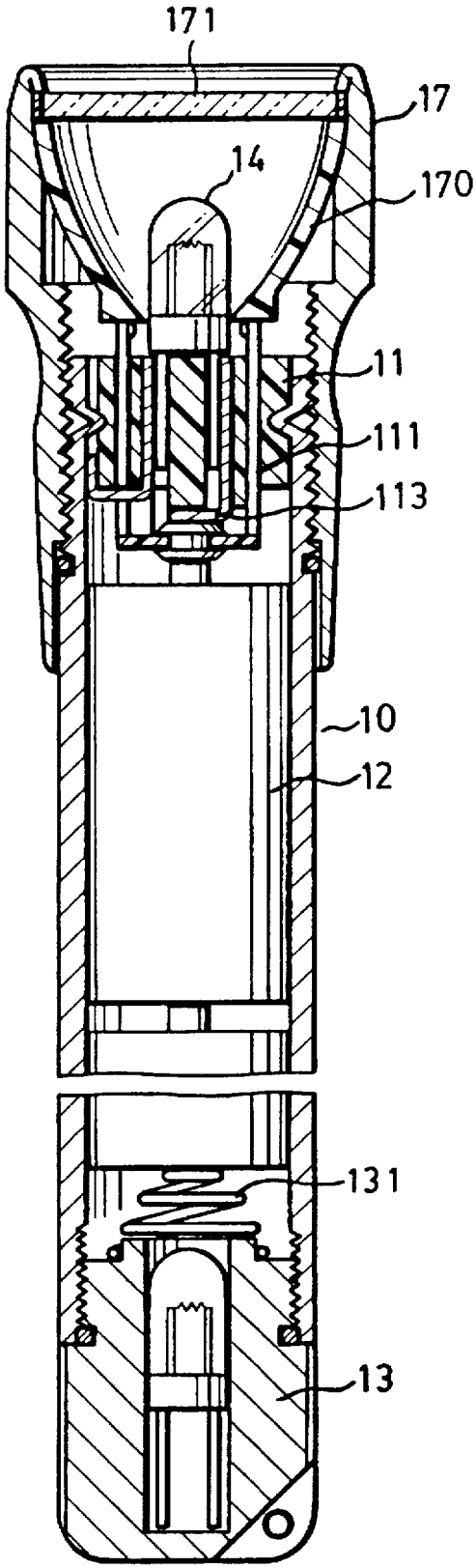
FIG. 1 PRIOR ART
FIG. 1 is a sectional view of a conventional variable focusing flashlight disclosed in U.S. Pat. No. 5,213,408.
Figure 2:
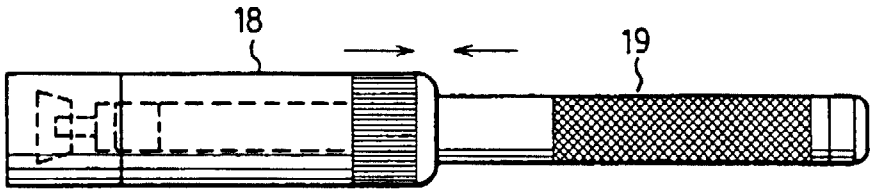
FIG.2 PRIOR ART
FIG. 2 is a side elevation view of a conventional multi-function lighting device disclosed in U.S. Pat. No. 5,412,548 when operated in a flashlight mode.
Figure 3:
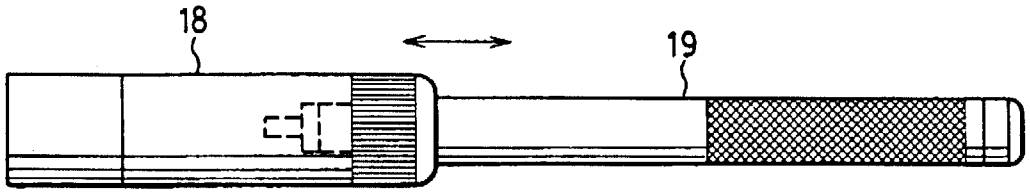
FIG.3 PRIOR ART
FIG. 3 is a side elevation view of the conventional lighting device shown in FIG. 2 when operated as a signaling baton.
Figure 4:
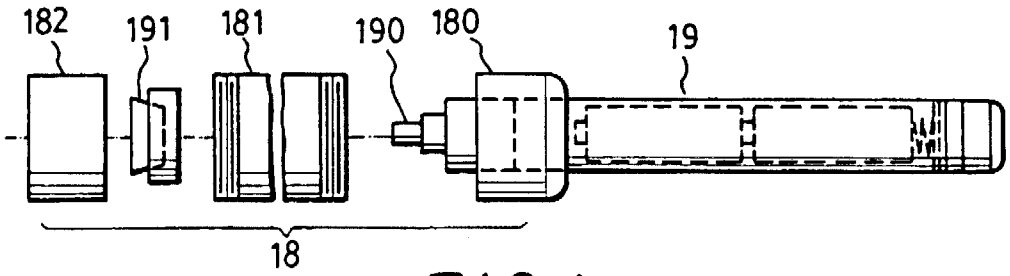
FIG.4 PRIOR ART
FIG. 4 is an exploded side elevation view of the conventional lighting device shown in FIG. 2.
Figure 5:
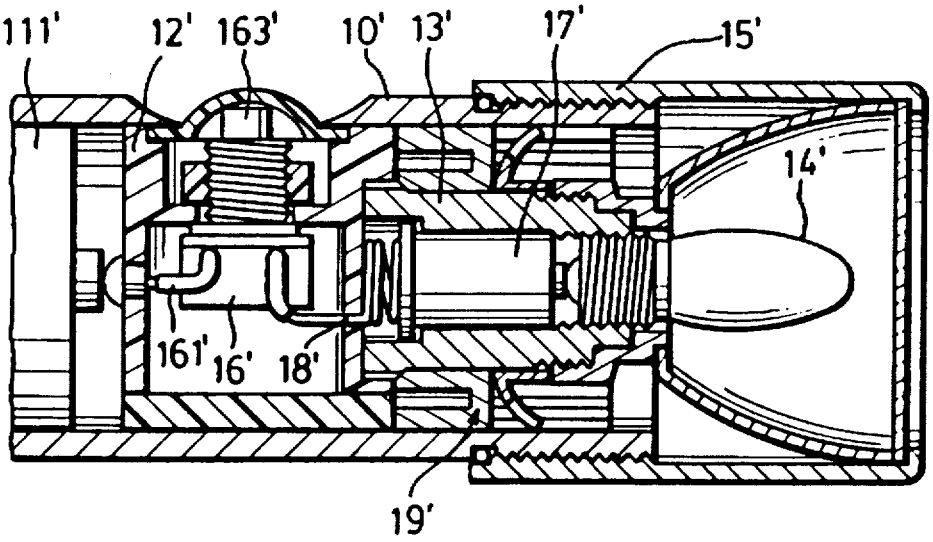
FIG.5 PRIOR ART
FIG. 5 is a fragmentary sectional view of a conventional flashlight disclosed in U.S. Pat. No. 5,282,116.
Figure 6:
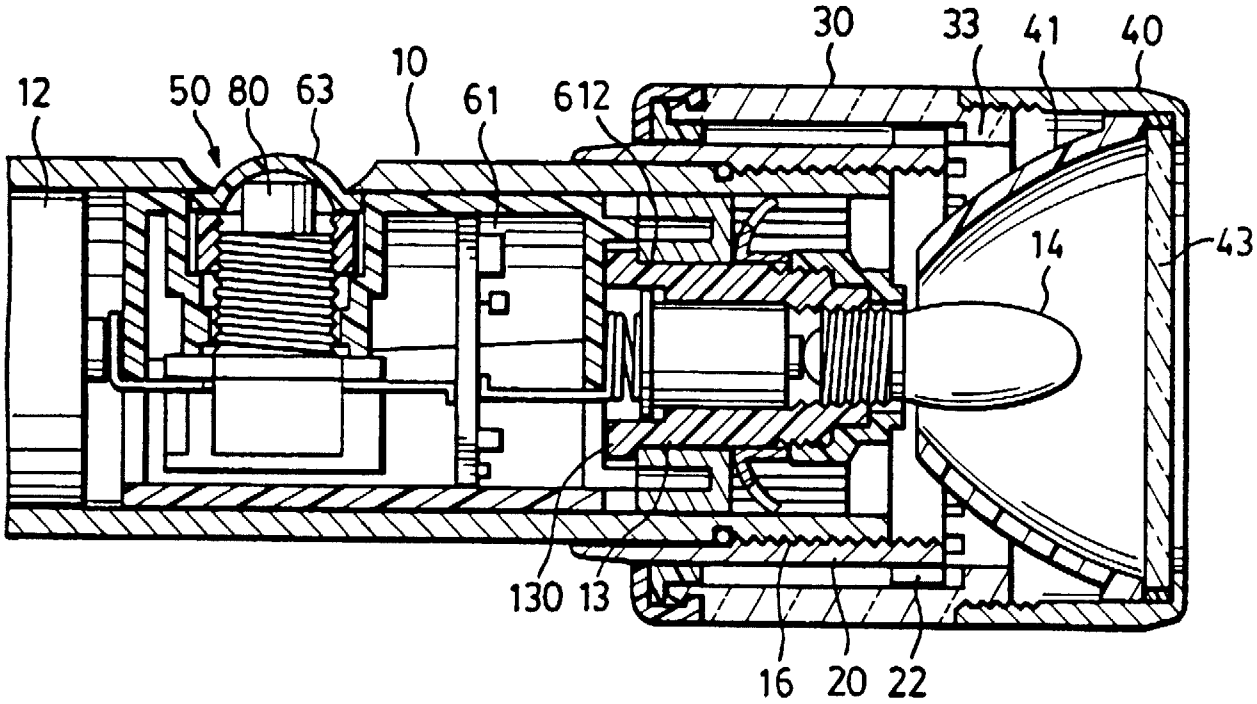
FIG. 6 is a fragmentary sectional view of the preferred embodiment of a multi-function lighting device according to the present invention.

Referring to FIG. 6, the preferred embodiment of a multi-function lighting device according to the present invention is shown to comprise a barrel 10, a head assembly including a coupling member 20, a sleeve member 30 and a head cap 40, and a switch assembly 50.

The barrel 10 houses a battery 12 therein. The switch assembly 50 is mounted in the barrel 10 adjacent to a front end of the latter. A conductive lamp socket 13 is mounted in the front end of the barrel 10 and has a lamp 14 retained thereon. The front end of the barrel 10 is formed with an external screw thread 16.

Figure 7:
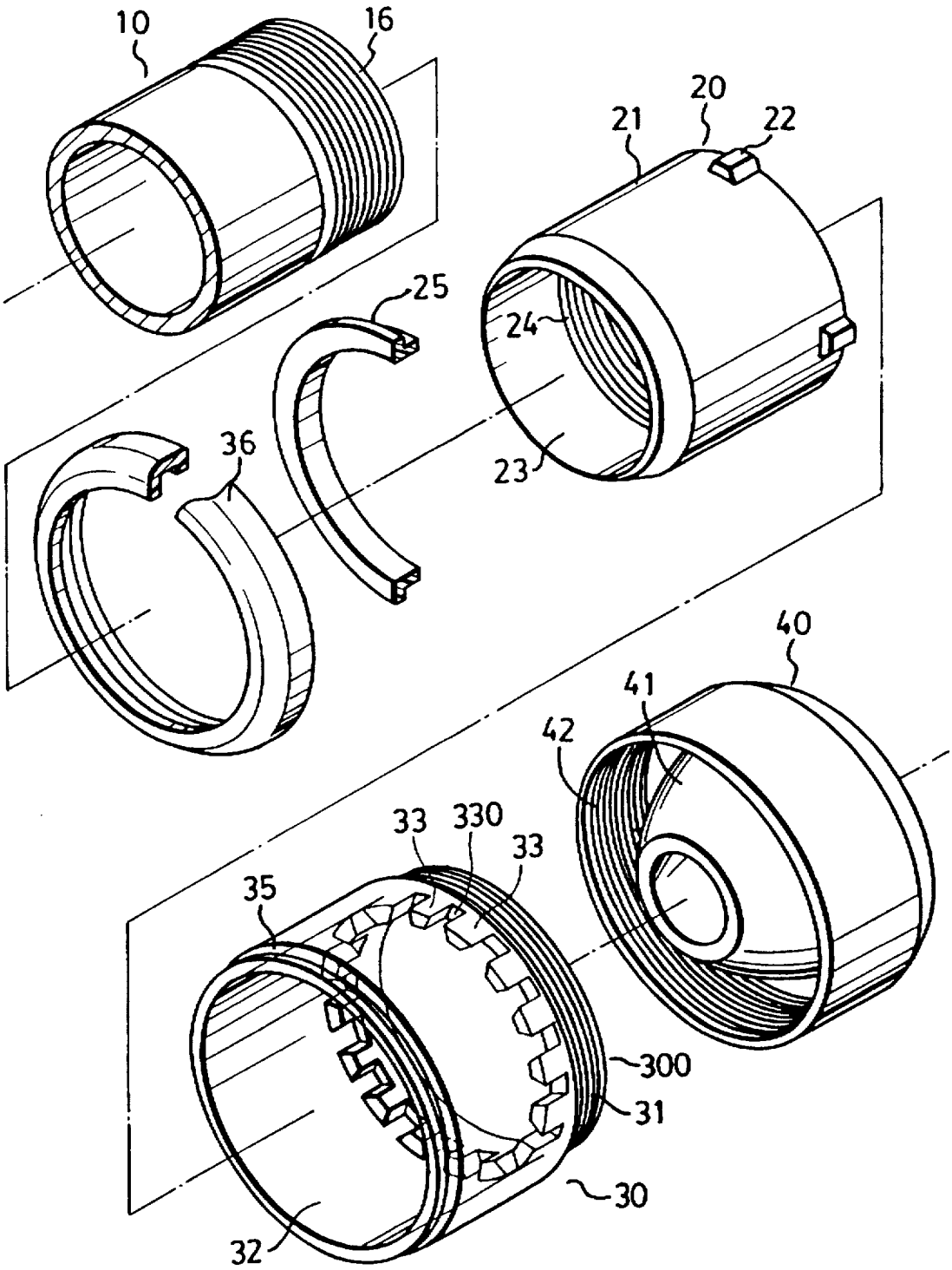
FIG. 7 is an exploded perspective view of a head assembly of the preferred embodiment.

Referring to FIGS. 6 and 7, the coupling member 20 is formed as a cylindrical tube and has an outer wall surface 21 formed with at least one locking projection 22, and an inner wall surface 23 formed with a screw thread 24 for engaging threadedly the screw thread 16 on the front end of the barrel 10. A seal ring 25 is disposed around the coupling member 20.

The sleeve member 30 is formed as an elongate cylindrical tube that is made of a transparent or translucent material so as to permit the transmission of light therethrough. Preferably, the sleeve member 30 is made of a colored, light transmittable material. The sleeve member 30 has a front end portion 300 formed with a screw thread 31 at an outer wall surface and a plurality of angularly spaced splines 33 at an inner wall surface 32. Adjacent splines 33 define a spline groove 330 therebetween for engaging removably the locking projection 22 on the coupling member 20. The sleeve member 30 further has a rear end portion formed with an annular retaining groove 35 for engaging an annular cap 36.

The head cap 40 is provided with a planar lens 43 and a parabolic reflector 41 with an open tail end to receive the lamp 14. The head cap 40 has an inner wall surface provided with a screw thread 42 for engaging threadedly the screw thread 31 on the sleeve member 30.

When installing the head assembly, the annular cap 36 and the seal ring 25 are initially removed from the sleeve member 30 and the coupling member 20, respectively. The coupling member 20 is then inserted through the sleeve member 30 via the rear end portion of the latter. Afterwards, the seal ring 25 is disposed around one end of the coupling member 20 opposite to the locking projection 22, and the sealing cap 36 is engaged within the retaining groove 35 of the sleeve member 30. Thereafter, the coupling member 20 is mounted on the barrel 10 by virtue of engagement between the screw threads 16, 24, and the head cap 40 is mounted on the sleeve member 30 by virtue of engagement between the screw threads 31, 42.

Figure 13:
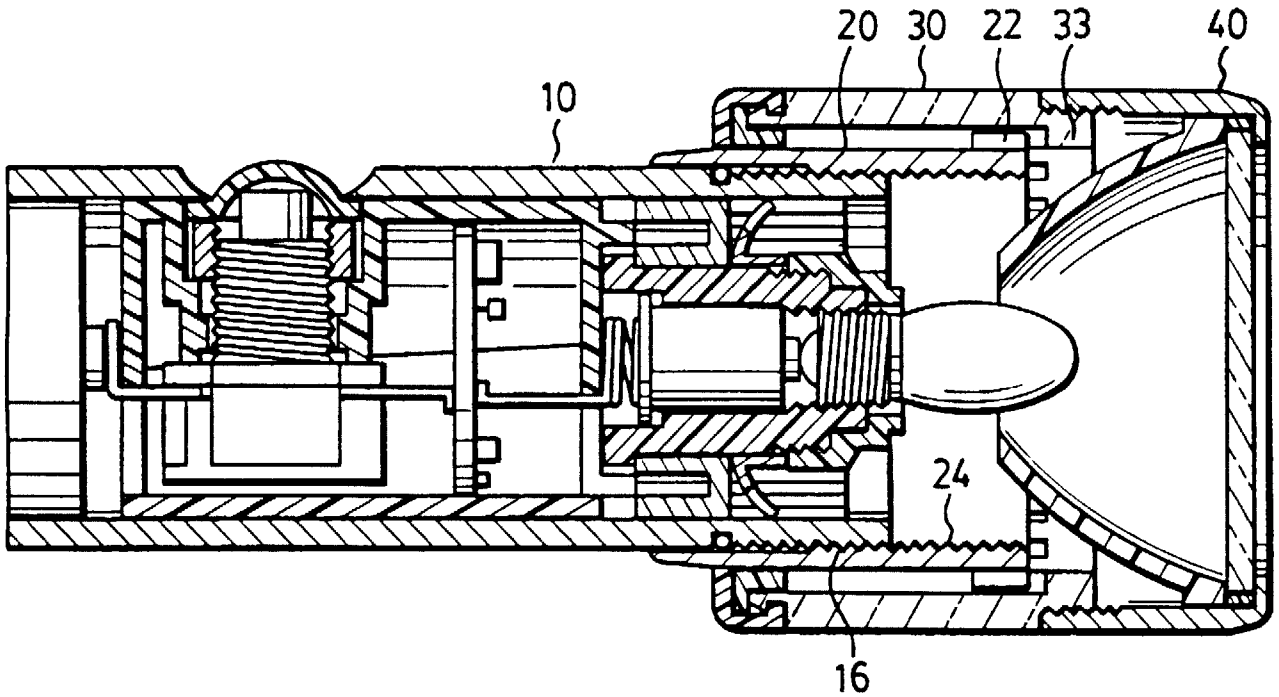
FIG. 13 is a sectional view of the preferred embodiment when operated in a flashlight mode.

When the preferred embodiment is operated in a flashlight mode, the head assembly is pulled toward the barrel 10 so that the lamp 14 extends into the reflector 41 in order to direct light axially. Light is unable to pass through the sleeve member 30 at this time. It is noted that direct rotation of the coupling member 20 relative to the barrel 10 is not possible when it is desired to vary the focusing of the preferred embodiment since the coupling member 20 is concealed within the sleeve member 30. However, in view of the engagement between the locking projection 22 on the coupling member 20 and the splines 33 on the sleeve member 30, rotation of the sleeve member 30 will cause the coupling member 20 to rotate therewith, as shown in FIG. 13. Since the screw threads 16, 24 mount adjustably the coupling member 20 on the barrel 10, the desired focusing can be maintained when the preferred embodiment is in use.

Figure 14:
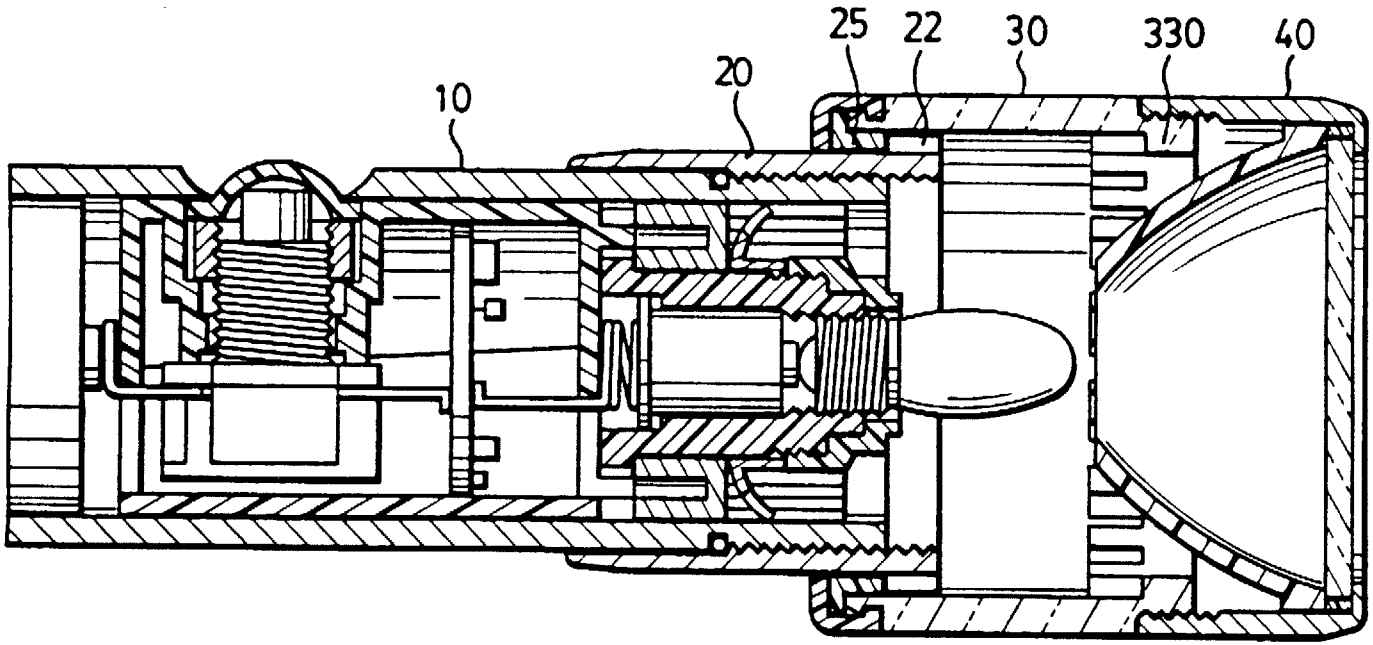
FIG. 14 is a sectional view of the preferred embodiment when operated as a signaling baton.

When operating the preferred embodiment as a signaling baton, the head assembly is pulled away from the barrel 10 so as to shift the sleeve member 30 with respect to the coupling member 20 such that the coupling member 20 ceases to be concealed within the sleeve member 30, as shown in FIG. 14. The locking projection 22 on the coupling member 20 ceases to engage the splines 33 on the sleeve member 30, and thus, rotation of the sleeve member 30 will not result in corresponding rotation of the coupling member 20. The seal ring 25 abuts against the locking projection 22 to limit movement of the sleeve member 30 relative to the coupling member 20, and the annular cap 36 prevents removal of the seal ring 25. At this time, the lamp 14 is located in the sleeve member 30 so that light can pass transversely through the sleeve member 30.

Aside from providing a waterproofing effect, the seal ring 25, which is disposed around the coupling member 20, is in tight frictional contact with the coupling member 20 and the sleeve member 30 to provide resistance to sliding movement of the sleeve member 30 relative to the coupling member 20. Thus, when the preferred embodiment is placed uprightly and face down on a flat surface, such as a table top, the sleeve member 30 can be retained at a desired position with respect to the coupling member 20 to permit operation of the preferred embodiment as a lantern.

Figure 8:
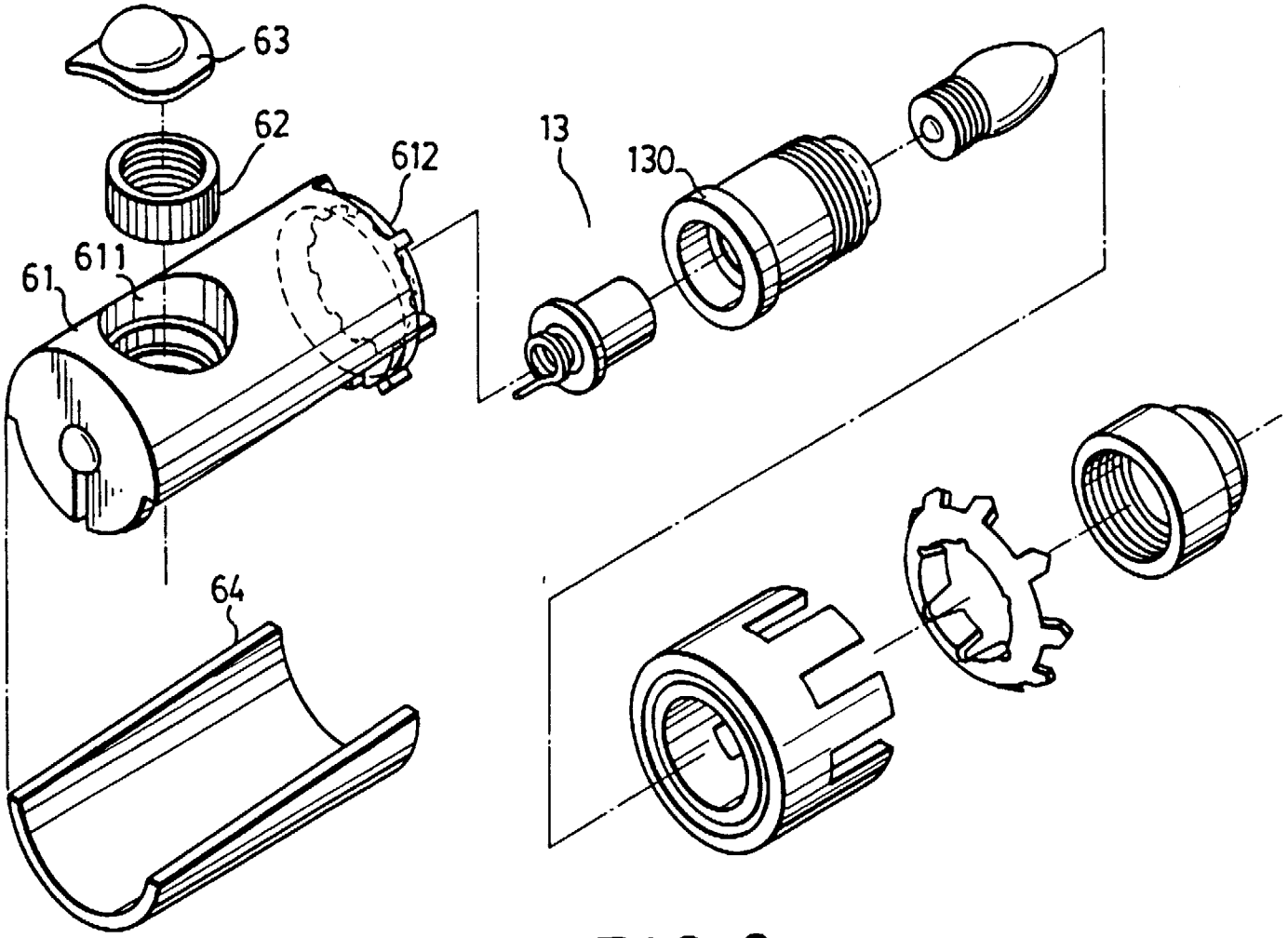
FIG. 8 is an exploded perspective view illustrating a switch assembly and a lamp socket assembly of the preferred embodiment.
Figure 9:
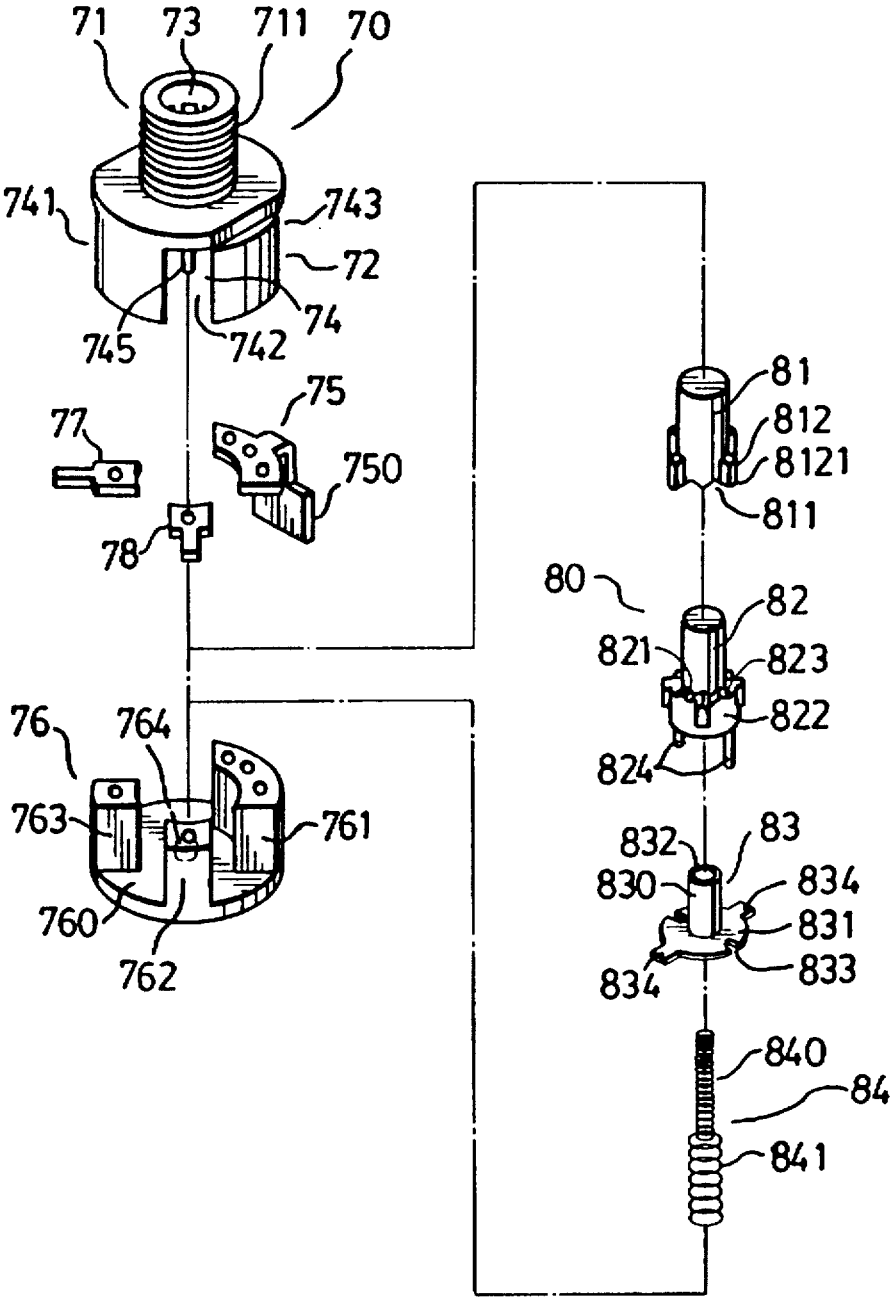
FIG. 9 is an exploded perspective view of a seat member and a button unit of the switch assembly of the preferred embodiment.

Referring to FIGS. 6, 8 and 9, the switch assembly 50 is connected electrically to the battery 12 in the barrel 10 and to the lamp 14 via the lamp socket 13. The switch assembly 50 comprises a switch casing 60 and a switching element which is mounted inside the switch casing 60 and which includes a seat member 70, a button unit 80 and a pulse generating circuit 90.

As shown in FIG. 8, the switch casing 60 includes first and second casing parts 61, 64, a locking unit 62, and a cover plate 63. The first casing part 61 is in the shape of a segmented cylinder while the second casing part 64 in the shape of a complementary segmented cylinder. The first and second casing parts 61, 64 have abutting surfaces which comprise sloping planes that incline longitudinally relative to an axis of the switch casing 60 and that have a conforming sloping relationship so that the first and second casing parts 61, 64 sealingly engage each other when the switch casing 60 is fitted in the barrel 10. The first casing part 61 is formed with a radial button retaining passage 611. The first casing part 61 further has a connecting end 612 which is adapted to engage a corresponding connecting end 130 of the lamp socket 13.

Figure 10:
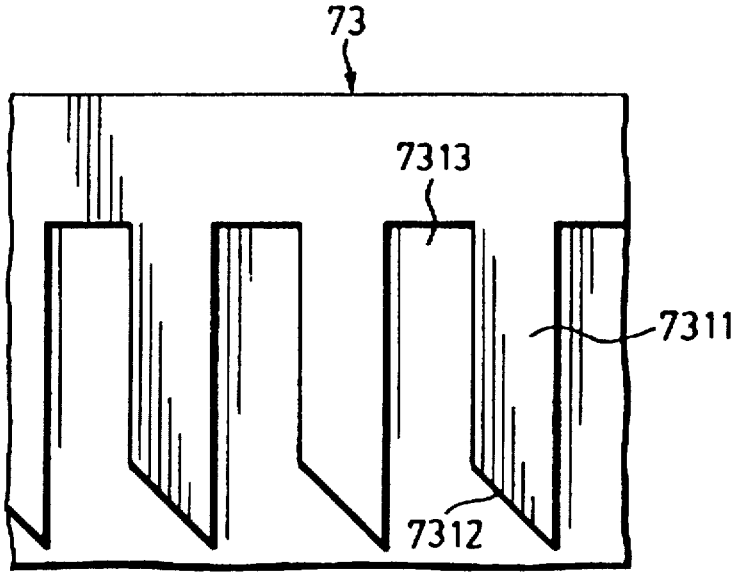
FIG. 10 is a fragmentary enlarged view in which an annular inner wall of a cylindrical head of the seat member is translated onto a plane.
Figure 12:
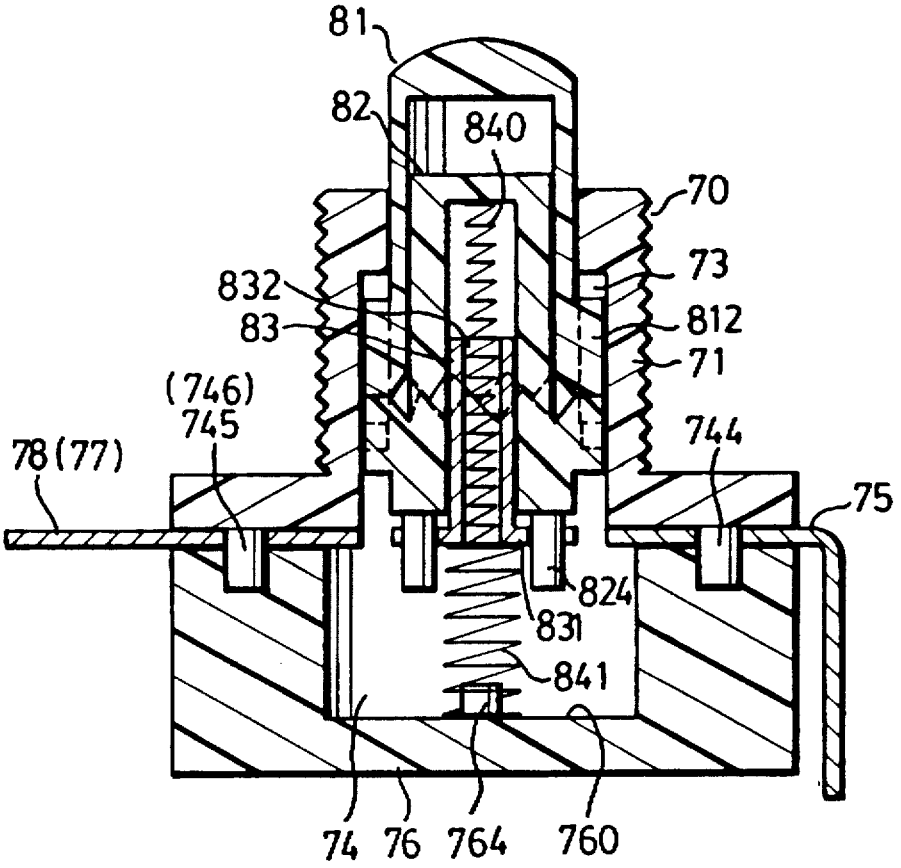
FIG. 12 is a sectional view of the switching element of the preferred embodiment.

As shown in FIG. 9, the seat member 70 includes a hollow cylindrical base 72 and a hollow cylindrical head 71 that extends from the cylindrical base 72. The cylindrical base 72 and the cylindrical head 71 respectively confine first and second chambers 73, 74. The cylindrical head 71 has an outer wall surface formed with a screw thread 711 which engages the locking unit 62 to retain the seat member 70 in the switch casing 60 (see FIG. 8). As shown in FIG. 10, the first chamber 73 is confined by an annular inner wall surface which is formed with a plurality of angularly spaced and vertically extending ribs 7311 that define a plurality of slide grooves 7313. Each rib 7311 has an inclined lowermost end surface 7312 which slopes from one adjacent slide groove 7313 to another adjacent slide groove 7313. In the present embodiment, the switch assembly 50 is provided with eight ribs 7311. Referring again to FIG. 9, the cylindrical base 72 is formed with three angularly spaced and axially extending slits 741, 742, 743, and three downwardly projecting positioning pins 744, 745, 746 disposed adjacent to the slits 741, 742, 743, respectively, as shown in FIG. 12. The seat member 70 is made of an insulator material and has first, second and third electrical contacts 75, 78, 77 mounted thereon. In this embodiment, the electrical contacts 75, 78, 77 extend radially into the cylindrical base 72 via the slits 741, 742, 743 and are secured respectively to the positioning pins 744, 745, 746. The first electrical contact 75 is formed with a downwardly extending contact plate portion 750 and is to be connected electrically to the battery 12. The second electrical contact 78 is to be connected electrically to the lamp 14. A bottom cover 76 is secured to the cylindrical base 72 to close the bottom end of the latter. The bottom cover 76 is formed with three angularly spaced and upwardly extending wall segments 761, 762, 763 which extend respectively into the slits 741, 742, 743 of the cylindrical base 72 for supporting the electrical contacts 75, 78, 77 on the positioning pins 744, 745, 746.

Referring once more to FIG. 9, the button unit 8 includes a tubular push rod 81, a tubular rotatable rod 82, a conductive connector 83 and a coil spring 84.

The rotatable rod 82 has a closed upper end portion and an open lower end portion. The lower end portion is formed with an outwardly extending radial flange 821. The radial flange 821 has a plurality of angularly spaced protrusions 822 which project outwardly and radially therefrom. In this embodiment, the radial flange 821 is formed with four protrusions 822. Each of the protrusions 822 has an inclined uppermost end surface which complements the inclined lowermost end surface 7312 of the ribs 7311. The protrusions 822 extend movably and respectively into the slide grooves 7313. The radial flange 821 further has an upper end surface formed with a plurality of angularly arranged teeth 823. The rotatable rod 82 further has two diametrically opposite connecting pins 824 which extend downwardly. The rotatable rod 82 is to be disposed movably and rotatably in the cylindrical head 71 of the seat member 70, as shown in FIG. 12.

The push rod 81 is disposed movably in the cylindrical head 71 and is sleeved on the rotatable rod 82. The push rod 81 has a closed upper end portion and an open lower end portion formed with a plurality of angularly arranged teeth 811 and a plurality of angularly spaced projections 812. In this embodiment, the push rod 81 is formed with four projections 812. The projections 812 project outwardly and radially from the lower end portion of the push rod 81 and respectively have an inclined lowermost end 8121. Like the protrusions 822, the projections 812 also extend movably and respectively into the slide grooves 7313.

The conductive connector 83 includes a conductive base plate 831 and a tubular shaft 830 which extends upwardly from the base plate 831. The tubular shaft 830 confines an axial through-hole 832 therethrough. The base plate 831 has a periphery formed with a pair of diametrically opposite retaining notches 833 and a pair of diametrically opposite and outwardly extending conductive contacts 834. The rotatable rod 82 is sleeved on the tubular shaft 830 such that the connecting pins 824 extend through the retaining notches 833, thereby enabling the conductive connector 83 to rotate with the rotatable rod 82, as shown in FIG. 12. Rotation of the conductive connector 83 causes the conductive contacts 834 to make or break electrical connection with the electrical contacts 75, 78, 77 on the seat member 70.

The coil spring 84 has an upper section 840 and a lower section 841 which is wider than the upper section 840. The conductive connector 83 is sleeved on the coil spring 84 such that the upper section 840 of the latter extends through the through-hole 832 in the tubular shaft 830 to abut against the upper end portion of the rotatable rod 82 in order to maintain a clearance between the lower end portion of the rotatable rod 82 and the base plate 831 of the conductive connector 83, and such that the base plate 831 is supported on the lower section 841 of the coil spring 84 to bias the base plate 831 upwardly in order to achieve proper contact with the electrical contacts 75, 78, 77. The lower section 841 of the coil spring 84 is then retained on a spring guide 764 that is formed on a base plate 760 of the bottom cover 76.

Figure 11:
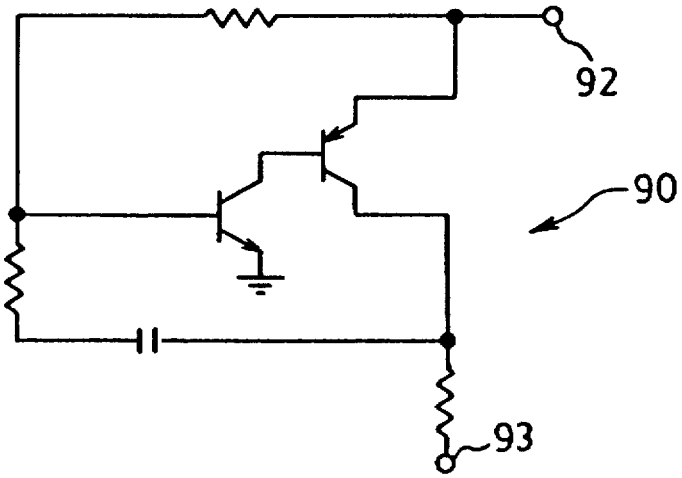
FIG. 11 is a schematic electrical circuit diagram of a pulse generating circuit of the preferred embodiment.

Referring now to FIG. 11, the pulse generating circuit 90 used in the preferred embodiment is configured as a charge-discharge circuit and has an input terminal 92 which is connected electrically to the third electrical contact 77 on the seat member 70, and an output terminal 93 which is connected electrically to the lamp 14. A pulse train signal is generated at the output terminal 93 whenever the input terminal 92 is connected to the battery 12 via the conductive connector 83 and the first electrical contact 75.

Referring to FIG. 12, the switch assembly 50 is assembled as follows: The push rod 81 is extended into the seat member 70 such that the projections 812 on the push rod 81 extend into the slide grooves 7313 between the ribs 7311 in the cylindrical head 71 of the seat member 70 and such that the push rod 81 extends out of the cylindrical head 71. The rotatable rod 82 is then extended into the push rod 81 via the open lower end portion of the latter. At this time, the protrusions 822 on the rotatable rod 82 also extend into the slide grooves 7313 of the seat member 70. The conductive connector 83 and the coil spring 84 are installed afterward. As mentioned beforehand, the upper section 840 of the coil spring 84 extends through the through-hole 832 in the tubular shaft 830 of the conductive connector 83 to abut against the upper end portion of the rotatable rod 82 in order to maintain a clearance between the lower end portion of the rotatable rod 82 and the base plate 831 of the conductive connector 83. The bottom cover 76 is then installed on the cylindrical base 72 of the seat member 70 to close the second chamber 74. The lower section 841 of the coil spring 84 is retained on the spring guide 764 of the bottom cover 76 at this time. The seat member 70 is mounted in the button retaining passage 611 of the switch casing 61 by the locking unit 62 (see FIG. 8). Prior to fitting of the switch casing 61 in the barrel 10, the cover plate 63 is installed in the barrel 10 adjacent to a radial opening in the latter such that a flexible dome-shaped portion of the same extends out of the radial opening, as shown in FIG. 6. When the switch casing 61 is installed in the barrel 10, the button unit 80 extends through the radial opening and is covered by the cover plate 63. The button unit 80 can be operated at this time.

Figure 18:
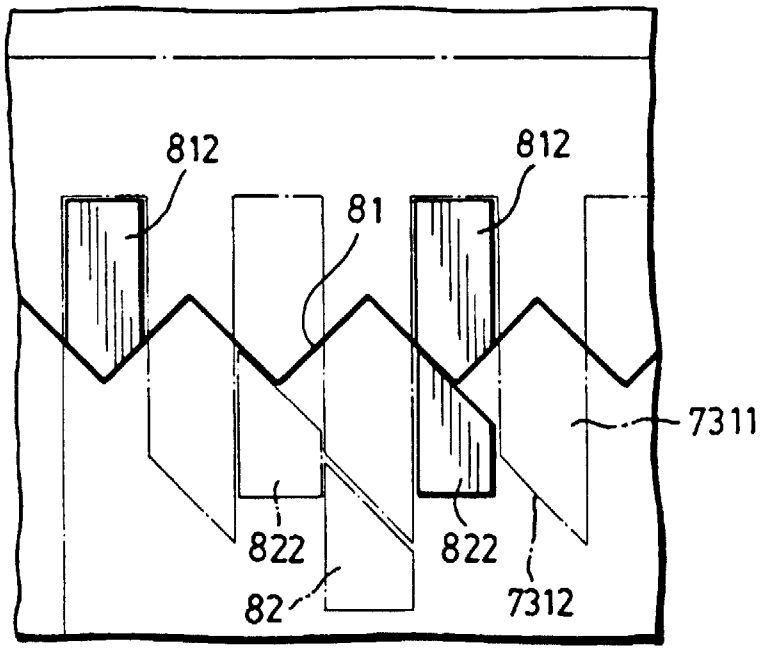
FIG. 18 is a view in which the annular inner wall of the cylindrical head of the seat member is translated onto a plane to illustrate operation of the switch assembly.

The lamp 14 can be controlled to operate in a deactivated state, in a constant light output state, or in a blinking light output state by applying pressure on the push rod 81. Referring to FIGS. 9, 12 and 18, the teeth 811 of the push rod 81 of the button unit 80 are initially misaligned with the teeth 821 of the rotatable rod 82. When pressure is applied on the upper end portion of the push rod 81, the push rod 81 moves axially downward relative to the seat member 70 to cause corresponding movement of the rotatable rod 82 and compression of the coil spring 84 so as to move the protrusions 822 of the rotatable rod 82 away from the slide grooves 7313 and so as to cause the teeth 811 of the push rod 81 of the button unit 80 to engage completely the teeth 821 of the rotatable rod 82, thereby rotating the rotatable rod 82 in order to misalign the protrusions 822 of the rotatable rod 82 with the slide grooves 7313 and cause the uppermost end surfaces of the protrusions 822 to abut against the lowermost end surface 7312 of the ribs 7311. When the applied pressure on the push rod 81 is removed, the coil spring 84 expands to bias the rotatable rod 82 toward the push rod 81, thereby causing the protrusions 822 of the rotatable rod 82 to move past the lowermost end surface 7312 of the ribs 7311 so as to extend once more into the slide grooves 7313 in order to rotate the rotatable rod 82.

It has thus been shown that application of pressure on the push rod 81 will cause the rotatable rod 82 to rotate by a predetermined angle. Since the base plate 831 of the conductive connector 83 is connected to the rotatable rod 82 via the connecting pins 824 and the notches 833, rotation of the rotatable rod 82 results in corresponding rotation of the conductive connector 83 to enable the latter to make or break electrical connection with the electrical contacts 75, 78, 77 on the seat member 70.

Figure 15:
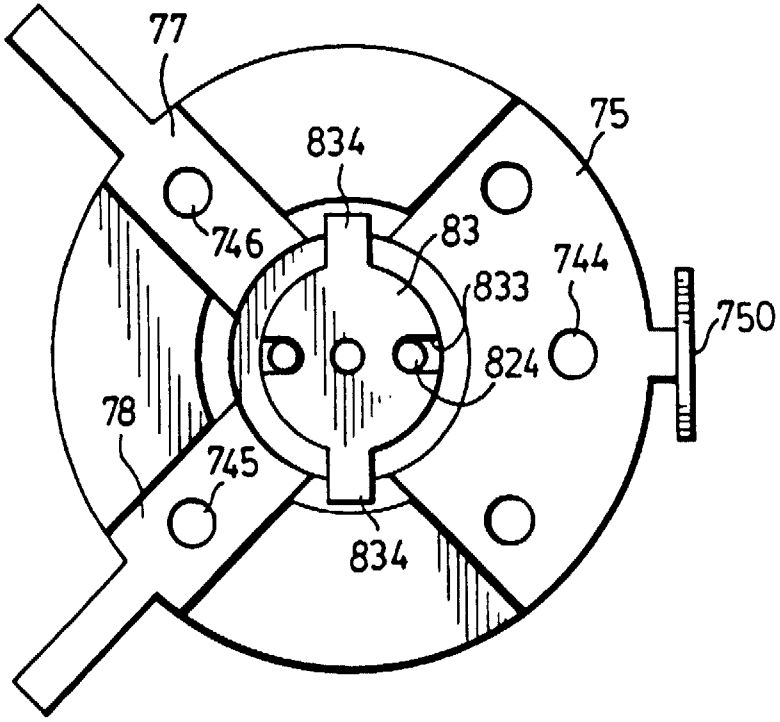
FIG. 15 is a bottom view illustrating a conductive connector and electrical contacts on the seat member when the connector is in a switch-off position.

When the push rod 81 is operated so that the base plate 831 is in the position shown in FIG. 15, the conductive contacts 834 on the conductive connector 83 are not in contact with any of the electrical contacts 75, 78, 77, thereby deactivating the lamp 14. The conductive connector 83 is in a switch-off position at this time.

Figure 16:
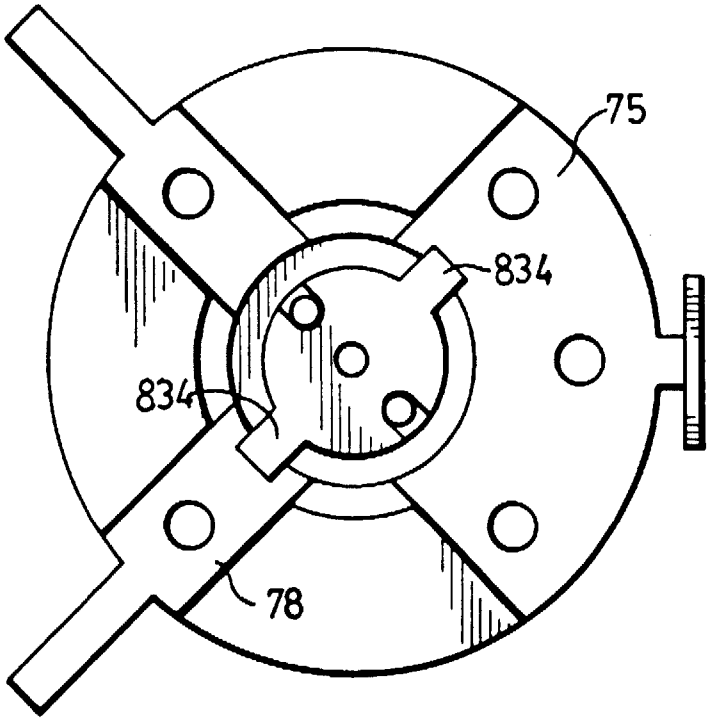
FIG. 16 is a bottom view illustrating the conductive connector and the electrical contacts on the seat member when the connector is in a first switch-on position.

When the push rod 81 is operated so that the base plate 831 is in the position shown in FIG. 16, the conductive contacts 834 are connected electrically with the first and second electrical contacts 75, 78. Since the first and second electrical contacts 75, 78 are connected respectively to the battery 12 and the lamp 14, the lamp 14 is enabled to generate a constant light output. The conductive connector 83 is in a first switch-on position at this time.

Figure 17:
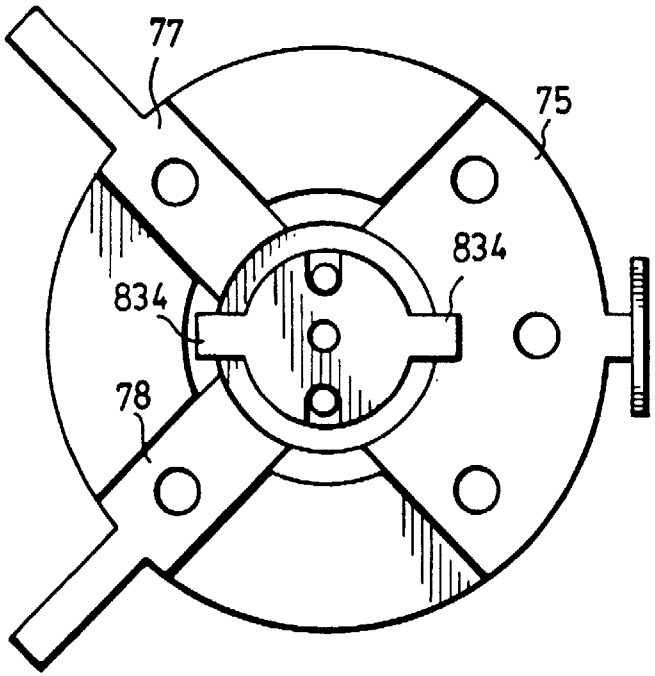
FIG. 17 is a bottom view illustrating the conductive connector and the electrical contacts on the seat member when the connector is moved from the first switch-on position to a second switch-on position.

When pressure is applied on the push rod 81 and then removed while the conductive connector 83 is in the first switch-on position, the conductive connector 83 rotates to the position shown in FIG. 17. One of the conductive contacts 834 is connected electrically with the first electrical contact 75. The remaining conductive contact 834 is not connected with any of the other electrical contacts 78, 77. Thus, the lamp 14 is deactivated at this time.

When pressure is applied on the push rod 81 and then removed while the conductive connector 83 is in the position shown in FIG. 17, the conductive connector 83 rotates such that the conductive contacts 834 are connected electrically with the first and third electrical contacts 75, 77. The pulse generating circuit 90 is connected to the battery 12 and is activated to generate a pulse train signal which is received by the lamp 14, thereby enabling the lamp 14 to generate a blinking light output. The conductive connector 83 is in a second switch-on position at this time.

Further operation of the push rod 81 while the conductive connector 83 is in the second switch-on position will result in movement of the conductive connector 83 to the switch-off position shown in FIG. 15.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A multi-function lighting device comprising a barrel, a lamp mounted on one end of said barrel, a tubular coupling member secured around said one end of said barrel, a tubular sleeve member made of a light transmittable material and sleeved slidably on said coupling member, a head cap secured to one end of said sleeve member and provided with a reflector therein, and a retaining unit, said sleeve member being continuously axially shiftable with respect to said coupling member and maintained in one of a plurality of intermediate positions with respect to said coupling member by said retaining unit between a first position, wherein said lamp extends into said reflector so that light may be directed axially, and a second position, wherein said lamp is located in said sleeve member and at least partially withdrawn from said reflector so that light can pass transversely through said sleeve member, the focus of said lighting device being determined by the intermediate position of said lamp between said first and second positions and relative to said reflector.

2. The multi-function lighting device as claimed in claim 1, wherein said one end of said barrel is threaded externally and said coupling member is threaded internally to engage threadably said one end of said barrel.

3. The multi-function lighting device as claimed in claim 1, wherein said one end of said sleeve member is threaded externally and said head cap is threaded internally to engage threadably said one end of said sleeve member.

4. The multi-function lighting device as claimed in claim 1, wherein:

said one end of said sleeve member has an inner wall surface formed with a plurality of angularly spaced splines which define a plurality of spline grooves; and said coupling member is formed with at least one radial locking projection which extends removably into one of said spline grooves to lock non-rotatably said sleeve member onto said coupling member so as to permit rotation of said coupling member with said sleeve member relative to said barrel when said sleeve member is in said first position.

5. The multi-function lighting device as claimed in claim 4, wherein said coupling member has a seal ring which is disposed therearound and which is in tight frictional contact with said coupling member and said sleeve member to permit retention of said sleeve member at a desired position with respect to said coupling member.

6. The multi-function lighting device as claimed in claim 5, wherein said sleeve member has an opposite end provided with an annular cap to prevent removal of said seal ring.

7. The multi-function lighting device as claimed in claim 1, wherein said barrel houses a battery therein, said lighting device further comprising a switch assembly mounted in said barrel and connected electrically to said battery and said lamp, said switch assembly being operable so as to interconnect electrically and selectively said battery and said lamp.

8. A multi-function lighting device comprising a barrel, a lamp mounted on one end of said barrel, a tubular coupling member secured around said one end of said barrel, a tubular sleeve member made of a light transmittable material and sleeved slidably on said coupling member, and a head cap secured to one end of said sleeve member and provided with a reflector therein, said sleeve member being shiftable with respect to said coupling member between a first position, wherein said lamp extends into said reflector so that light may be directed axially, and a second position, wherein said lamp is located in said sleeve member so that light can pass transversely through said sleeve member;

wherein said barrel houses a battery therein, said lighting device further comprising a switch assembly mounted in said barrel and connected electrically to said battery and said lamp, said switch assembly being operable so as to interconnect electrically and selectively said battery and said lamp; and said switch assembly comprising:

an insulated hollow seat member mounted to said barrel and having angularly spaced first, second and third electrical contacts mounted thereon, said first electrical contact being connected electrically to said battery, said second electrical contact being connected electrically to said lamp;

a pulse generating circuit having an input terminal connected electrically to said third electrical contact and an output terminal connected electrically to said lamp; and a conductive connector disposed rotatably in said seat member and formed with a pair of conductive contacts, said connector being manually operable to rotate relative to said seat member among a switch-off position, wherein said conductive contacts of said connector are not in contact with said electrical contacts on said seat member so as to turn off said lamp, a first switch-on position, wherein said conductive contacts of said connector are in contact with said first and second electrical contacts on said seat member so as to control said lamp to generate a constant light output, and a second switch-on position, wherein said conductive contacts of said connector are in contact with said first and third electrical contacts on said seat member so as to control said lamp to generate a blinking light output.

9. The multi-function lighting device as claimed in claim 1, wherein said retaining unit further comprises waterproofing means.

* * * * *